US009209566B2

(12) United States Patent
Lee et al.

(10) Patent No.: US 9,209,566 B2
(45) Date of Patent: Dec. 8, 2015

(54) CONNECTOR FOR PREVENTING UNLOCKING

(75) Inventors: Yong Goo Lee, Seoul (KR); Kyoung Il Kang, Suwon-si (KR); Dong Il Lim, Suwon-si (KR); Chong Ho Chi, Seoul (KR)

(73) Assignees: Defense Agency for Technology and Quality, Seoul (KR); Gigalane Co., Ltd., Hwaseong-si (KR)

( * ) Notice: Subject to any disclaimer, the term of this patent is extended or adjusted under 35 U.S.C. 154(b) by 115 days.

(21) Appl. No.: 14/233,061

(22) PCT Filed: Jul. 10, 2012

(86) PCT No.: PCT/KR2012/005439

§ 371 (c)(1),
(2), (4) Date: Jan. 15, 2014

(87) PCT Pub. No.: WO2013/015544

PCT Pub. Date: Jan. 31, 2013

(65) Prior Publication Data

US 2014/0154906 A1 Jun. 5, 2014

(30) Foreign Application Priority Data

Jul. 27, 2011 (KR) ..... 10-2011-0074705

(51) Int. Cl.

| | |
|---|---|
| ***H01R 13/62*** | (2006.01) |
| ***H01R 13/639*** | (2006.01) |
| ***H01R 13/622*** | (2006.01) |
| *H01R 103/00* | (2006.01) |
| *H01R 24/52* | (2011.01) |
| *H01R 13/625* | (2006.01) |

(52) U.S. Cl.

CPC ..... *H01R 13/639* (2013.01); *H01R 13/622* (2013.01); *H01R 13/6395* (2013.01); *H01R 13/625* (2013.01); *H01R 24/52* (2013.01); *H01R 2103/00* (2013.01)

(58) Field of Classification Search

USPC ..... 439/312, 318, 321
IPC ..... H01R 13/622,13/623, 13/625, 13/595, H01R 13/639
See application file for complete search history.

(56) References Cited

U.S. PATENT DOCUMENTS

| | | | | |
|---|---|---|---|---|
| 4,445,743 | A * | 5/1984 | Bakker | 439/314 |
| 4,462,653 | A | 7/1984 | Flederbach et al. | |
| 4,749,251 | A | 6/1988 | Moulin | |
| 5,082,454 | A * | 1/1992 | Tonkiss et al. | 439/320 |

(Continued)

FOREIGN PATENT DOCUMENTS

| | | | |
|---|---|---|---|
| EP | 0080930 | A2 | 6/1983 |
| EP | 1717905 | A1 | 11/2006 |

(Continued)

*Primary Examiner* — Hien Vu
(74) *Attorney, Agent, or Firm* — The Webb Law Firm

(57) ABSTRACT

Disclosed is a connector for preventing unlocking which includes a signal pin transferring a signal; a body into which the signal pin is inserted and which is electrically isolated from the signal pin; a first housing having a hollow portion into which one end of the body is inserted, a thread groove and at least one protruding portion or a plurality of fixing grooves formed at an inner circumferential surface of the other end thereof; and a second housing having a hollow portion into which the other body end is inserted and through which the second housing is moved along an outer circumferential surface of the body in an axial direction.

7 Claims, 12 Drawing Sheets

(56) References Cited

U.S. PATENT DOCUMENTS

| | | | | |
|---|---|---|---|---|
| 6,557,900 | B1 * | 5/2003 | Austin | 285/92 |
| 7,438,579 | B1 * | 10/2008 | Pellen | 439/312 |
| 7,905,741 | B1 * | 3/2011 | Wade et al. | 439/321 |
| 8,008,576 | B2 * | 8/2011 | Fuzetti | 174/59 |
| 8,656,575 | B1 * | 2/2014 | Bulow | 29/525.01 |
| 2005/0181668 | A1 | 8/2005 | Montena et al. | |
| 2006/0240709 | A1 | 10/2006 | Montena et al. | |
| 2010/0055978 | A1 | 3/2010 | Montena | |

FOREIGN PATENT DOCUMENTS

| | | | |
|---|---|---|---|
| JP | 97705 | A | 1/1997 |
| KR | 1020070037871 | A | 4/2007 |
| KR | 1020080061468 | A | 7/2008 |
| KR | 1020090048011 | A | 5/2009 |
| KR | 2020090012198 | U | 12/2009 |
| TW | 200742205 | A | 11/2007 |
| WO | 8700352 | A1 | 1/1987 |

* cited by examiner

Prior Art

CONNECTOR FOR PREVENTING UNLOCKING

CROSS-REFERENCE TO RELATED APPLICATIONS

This application is the U.S. national phase of International Application No. PCT/KR2012/005439 filed Jul. 10, 2012 and claims priority to Korean Application No. 10-2011-0074705 filed Jul. 27, 2011, the disclosures of which are hereby incorporated by reference in their entirety.

TECHNICAL FIELD

The present invention relates to a connector, and more particularly, to a connector for preventing unlocking, which can prevent unlocking with a target object coupled.

BACKGROUND ART

Generally, a connector is used as a connecting means for transferring an electric signal between target objects (e.g., a cable, an electronic device or the like). However, if one end of the connector is coupled with a target object through a screw or the like, coupling force therebetween may become weak over time, and thus the target object may be unlocked from the connector. In order to solve the problem, there has been proposed a connector structure as illustrated in FIG. 1.

FIG. 1 is a view of a conventional connector 130 having a lock wire 140.

Referring to FIG. 1, one target object 110 and other target object 120 are coupled to each other by a connector 130. That is, one end of the connector 130 is coupled to the one target object 110 and the other end thereof is coupled to the other target object 120 such that the target objects 110 and 120 may be electrically connected with each other through the connector 130. And in order to prevent unlocking between the target object 120 and the connector 130, the target object 120 and the connector 130 are coupled once more by using a lock wire 140. That is, the lock wire 140 is applied to the target object 120 and the connector 130 while the target object 120 and the connector 130 are coupled in a screwing manner, and thereby the screw-coupling between the target object 120 and the connector 130 is prevented from being unlocked.

However, in the case of using the lock wire 140, since the target object 120 and the connector 130 are coupled to each other and then the lock wire 140 has to be coupled once more, it is very inconvenient and also it takes an excessive assembly time. Further, since the lock wire 140 is located on the outside, it may be easily damaged. Also if the lock wire 140 is damaged, the coupling between the target object 120 and the connector 130 may be unlocked.

DISCLOSURE

Technical Problem

The present invention is directed to providing a connector for preventing unlocking, which can prevent the unlocking between the connector and a target object which are screw-coupled by using a fixing groove and a protruding portion formed in a housing to protect from foreign substances.

Technical Solution

One aspect of the present invention provides a connector for preventing unlocking, including a signal pin transferring a signal; a body into which the signal pin is inserted and which is electrically isolated from the signal pin by an insulator and transfers a ground voltage; a first housing having a hollow portion defined therein, into which one end of the body is inserted, a thread groove for screw-coupling, which is defined in an inner circumferential surface of one end thereof, and at least one protruding portion or a plurality of fixing grooves formed on or in an inner circumferential surface of the other end thereof; and a second housing having a hollow portion defined therein, into which the other end of the body is inserted and through which the second housing is moved along an outer circumferential surface of the body in an axial direction, and one of the at least one protruding portion and the plurality of fixing grooves, which is not formed at the first housing but is formed on or in an outer circumferential surface of one end thereof, wherein, when the one end of the second housing is inserted and fixed between the inner circumferential surface of the other end of the first housing and the outer circumferential surface of the body, the at least one protruding portion is coupled in the plurality of fixing grooves so as to prevent rotation of the first housing.

When the at least one protruding portion is formed on the inner circumferential surface of the other end of the first housing, the fixing grooves may be formed in the outer circumferential surface of the one end of the second housing, and, when the fixing grooves are formed on the inner circumferential surface of the other end of the first housing, the at least one protruding portion may be formed in the outer circumferential surface of the one end of the second housing.

When the thread groove of the first housing is screw-coupled, the second housing may be fixed in a state in which the fixing grooves and the at least one protruding portion are separated from each other and thus prevented from being moved in an axial direction, and when the at least one protruding portion is coupled in the fixing grooves, the second housing may be fixed and prevented from being moved in the axial direction and rotated.

The connector may further include an elastic body which is supported by the body and provides elasticity to the second housing moving in the axial direction.

When the at least one protruding portion is coupled in the fixing grooves, the elastic body may provide the elasticity to the second housing so as to prevent the second housing from being moved in the axial direction.

The body may have at least one protrusion formed on the other end thereof, and the second housing may have at least one through-hole defined in the other end thereof, in which the at least one protrusion is coupled to prevent the second housing from being moved in the axial direction and rotated.

The through-hole may include an axial movement preventing through-hole defined in a direction that is not parallel with the axial direction so that the protrusion is coupled therein and thus the second housing is fixed to the body and prevented from being moved in the axial direction; and a rotation preventing through-hole which is integrally defined with the axial movement preventing through-hole and defined in the axial direction so that the protrusion is coupled therein and thus the second housing is fixed to the body and prevented from being rotated.

The second housing may include a first coupling portion which has the fixing grooves defined in an outer circumferential surface thereof, and is moved along the outer circumferential surface of the body in the axial direction, when receiving the elasticity from the elastic body, such that the at least one protruding portion formed on the first housing is inserted into the fixing grooves; and a second coupling portion which is integrally defined with the first coupling portion, and has larger inner and outer diameters than the first coupling portion, and of which one end is in close contact with the other end of the first housing when a portion thereof coupled with the first coupling portion receives the elasticity from the elastic body, and the other end has the at least one through-hole.

The second housing may include a first coupling portion which has the at least one protruding portion defined in an outer circumferential surface thereof, and is moved along the outer circumferential surface of the body in the axial direction, when receiving the elasticity from the elastic body, is configured such that the at least one protruding portion is inserted into the fixing grooves defined in the first housing; and a second coupling portion which is integrally defined with the first coupling portion, and has larger inner and outer diameters than the first coupling portion, and of which one end is in contact with the other end of the first housing when a portion thereof coupled with the first coupling portion receives the elasticity from the elastic body, and the other end has the at least one through-hole.

The second housing may include a first coupling portion which has the fixing grooves defined in an outer circumferential surface thereof, and is moved along the outer circumferential surface of the body in the axial direction, when receiving the elasticity by the elastic body, such that the at least one protruding portion formed on the first housing is inserted into the fixing grooves; and a second coupling portion which is integrally defined with the first coupling portion, and has larger inner and outer diameters than the first coupling portion, and of which one end is in contact with the other end of the first housing when a portion thereof coupled with the first coupling portion receives the elasticity by the elastic body, and the other end has the at least one through-hole.

An end of the protruding portion may have a rounded shape, and a boundary portion between the fixing grooves may have a smaller width than the protruding portion so that the protruding portion and the fixing grooves are easily coupled with each other, and an end of the boundary portion on a side of the protruding portion may have an inclined portion.

The first housing may have an axial movement preventing portion which protrudes along an inner circumferential surface thereof between the thread groove and the portion on which the at least one protruding portion or the fixing grooves are formed so as to be inserted into a groove defined in the outer circumferential surface of the body and thus prevent the first housing from being moved in the axial direction.

The connector for preventing unlocking may be a radio frequency (RF) connector transferring a high frequency signal.

Advantageous Effects

In the connector for preventing unlocking according to one embodiment of the present invention, the target object is screw-coupled to the connector without using of a separate wire, and the protruding portion and the fixing grooves are coupled with each other so that the connector coupled with the target object is not rotated in any direction, and thereby it is possible to minimize the assembly time and also to prevent the unlocking between the connector and the target object. Further, the protruding portion and the fixing grooves are formed in the housing, and thus it is possible to prevent the protruding portion and the fixing grooves from being damaged by foreign substances.

MODES OF THE INVENTION

Hereinafter, reference will now be made in detail to the exemplary embodiments of the present invention, examples of which are illustrated in the accompanying drawings. Wherever possible, the same reference numbers will be used throughout the drawings to refer to the same or like parts.

Figure 1:
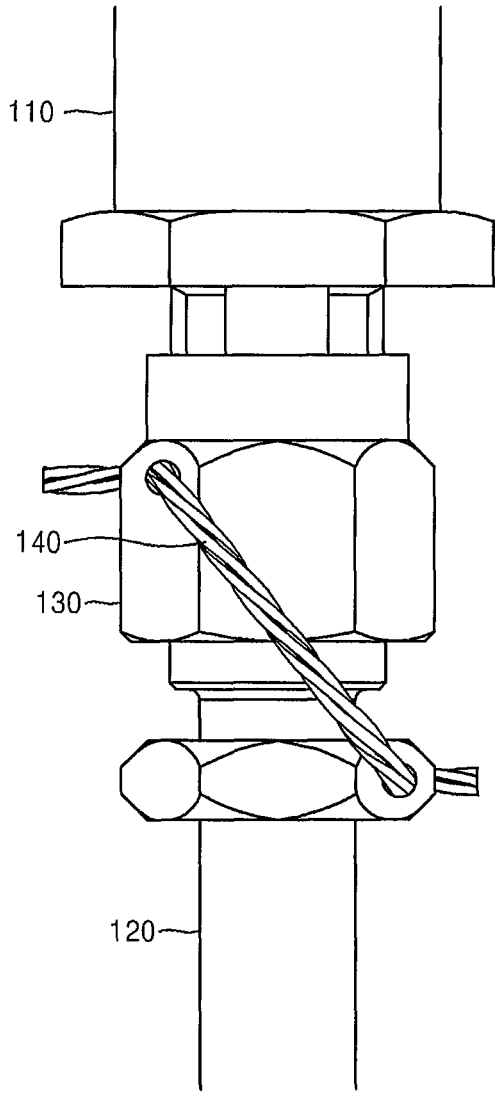
FIG. 1 is a view of a conventional connector to which a lock wire is coupled.
Figure 2:
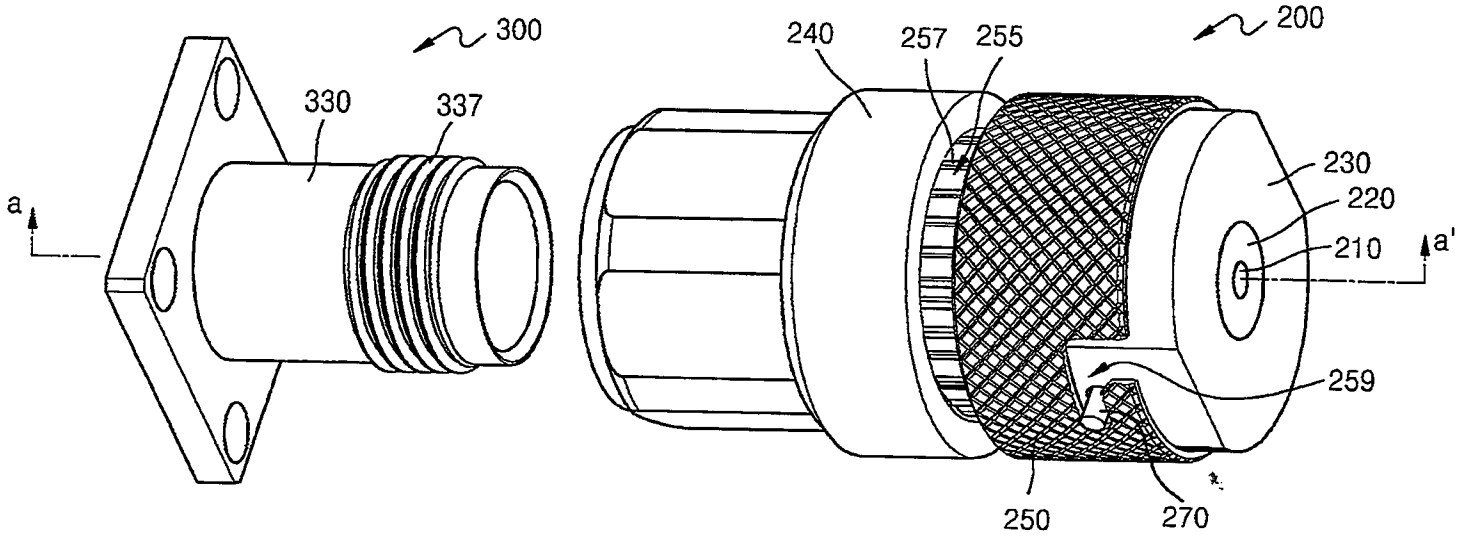
FIG. 2 is a perspective view of a connector for preventing unlocking and a target object coupled to the connector for preventing unlocking according to one exemplary embodiment of the present invention.
Figure 3:
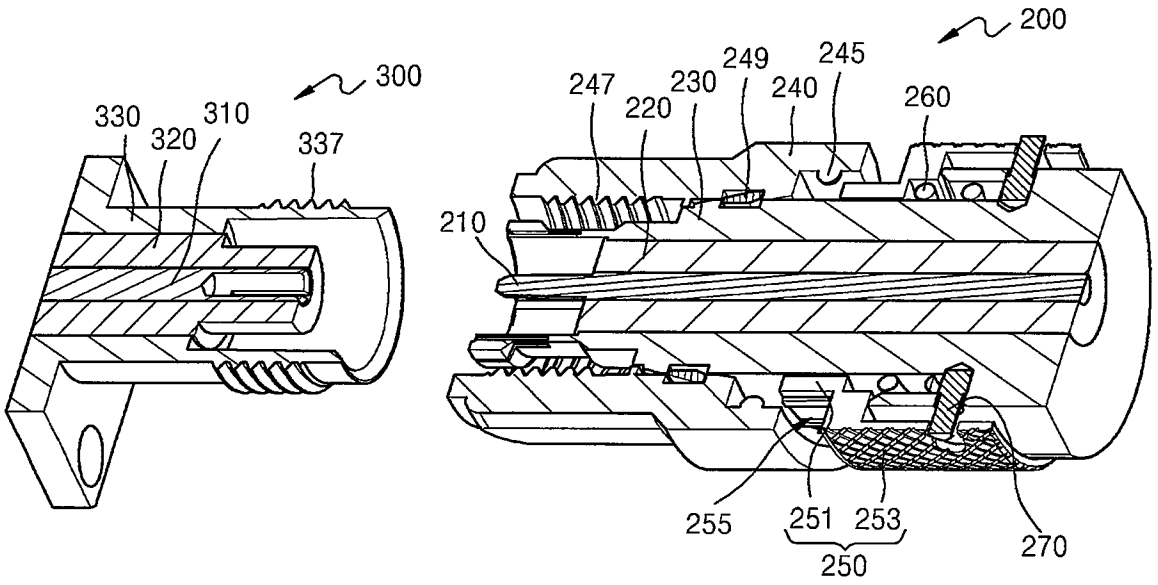
FIG. 3 is a cross-sectional perspective view taken along a line a-a' of the connector for preventing unlocking and the target object of FIG. 2.

FIG. 2 is a perspective view of a connector 200 for preventing unlocking and a target object 300 coupled to the connector 200 for preventing unlocking according to one exemplary embodiment of the present invention, and FIG. 3 is a cross-sectional perspective view taken along a line a-a' of the connector 200 for preventing unlocking and the target object 300 of FIG. 2.

Figure 4:
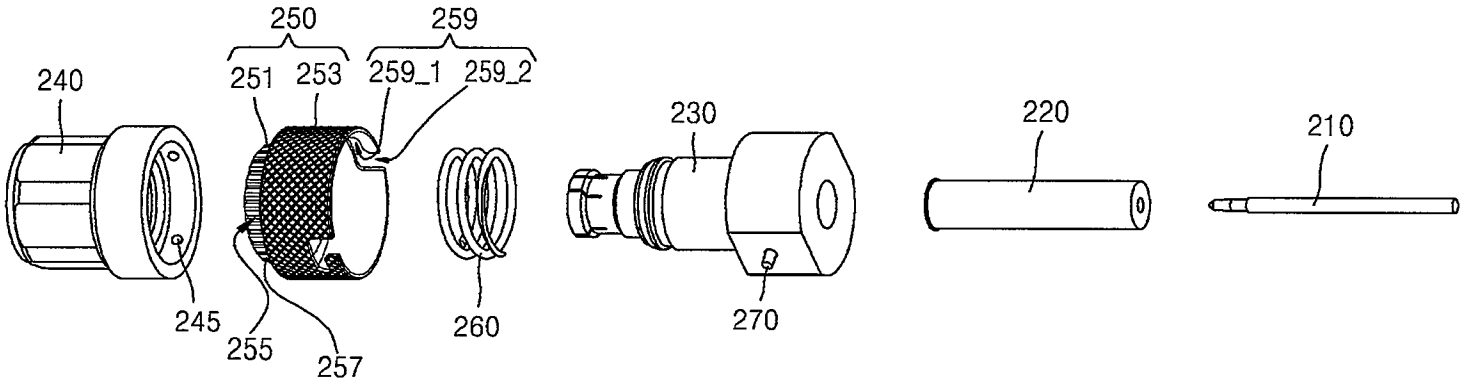
FIG. 4 is an exploded perspective view of the connector for preventing unlocking of FIG. 2 according to one exemplary embodiment of the present invention.
Figure 5:
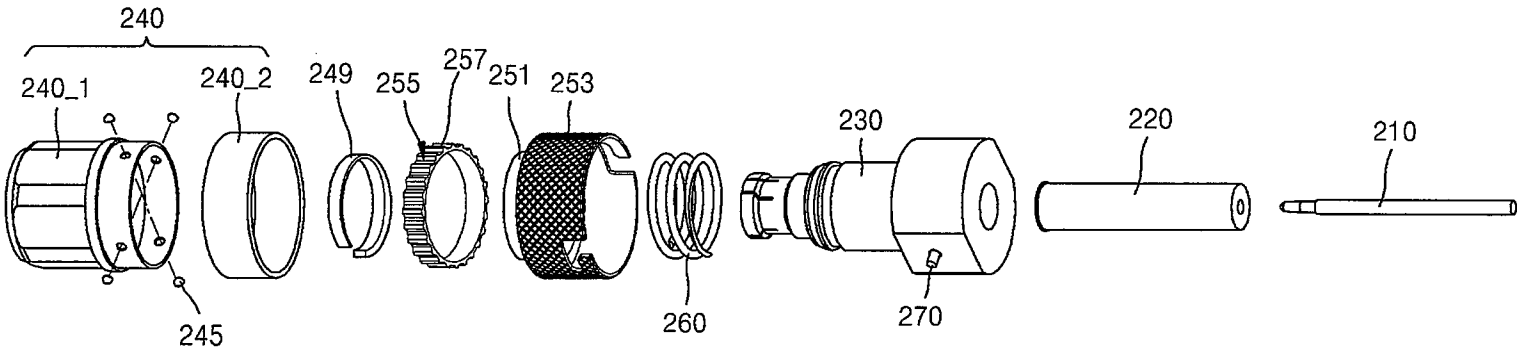
FIG. 5 is an exploded perspective view of the connector for preventing unlocking of FIG. 2 according to another exemplary embodiment of the present invention.

FIG. 4 is an exploded perspective view of the connector 200 for preventing unlocking of FIG. 2 according to one exemplary embodiment of the present invention, and FIG. 5 is an exploded perspective view of the connector 200 for preventing unlocking of FIG. 2 according to another exemplary embodiment of the present invention.

Figure 6:
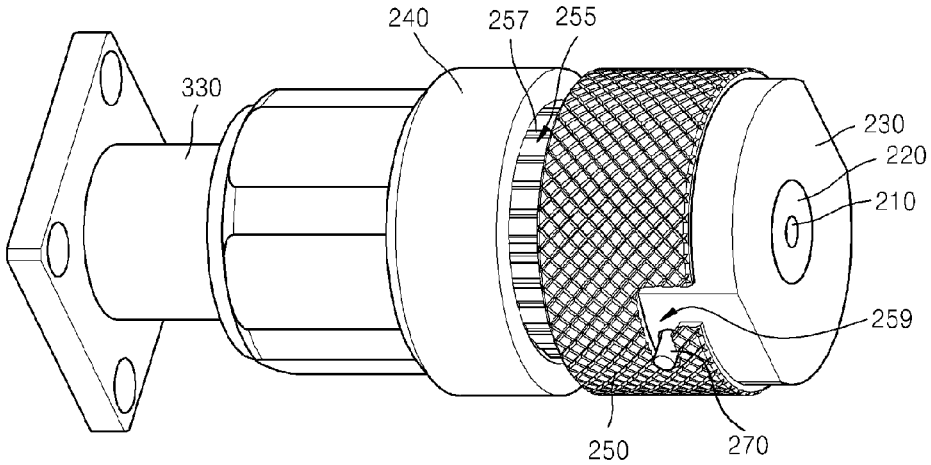
FIG. 6 is a perspective view illustrating a state in which the connector for preventing unlocking and the target object of FIG. 2 are screw-coupled to each other.
Figure 7:
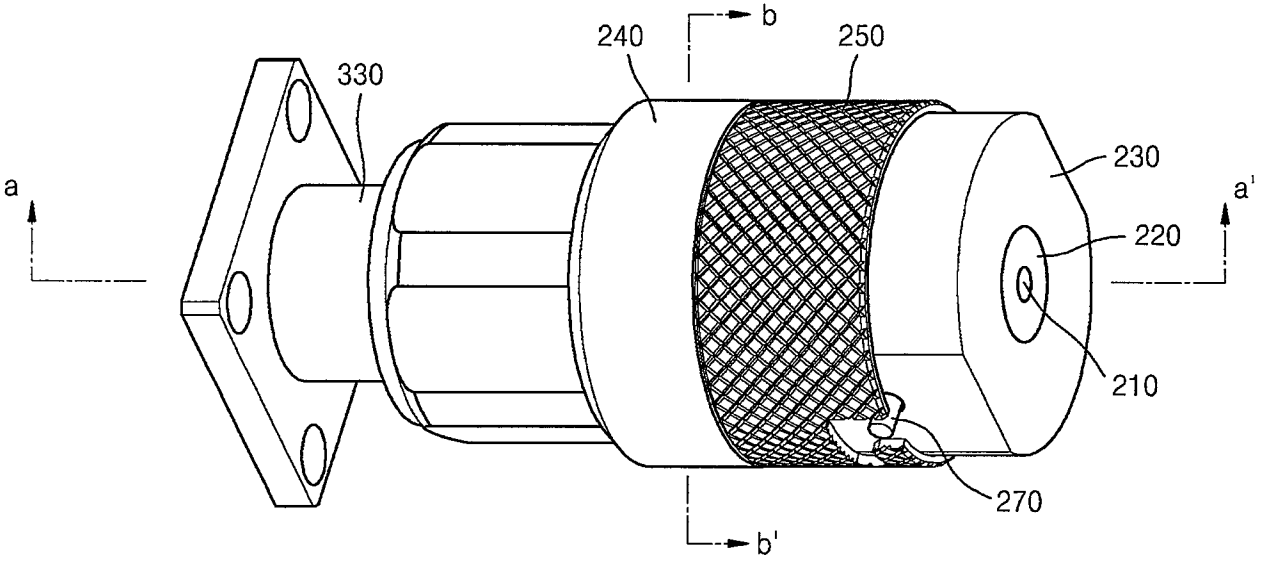
FIG. 7 is a perspective view illustrating a state in which the connector for preventing unlocking and the target object are screw-coupled to each other like in FIG. 6, and thus the unlocking therebetween is prevented.

FIG. 6 is a perspective view illustrating a state in which the connector 200 for preventing unlocking and the target object 300 of FIG. 2 are screw-coupled to each other, and FIG. 7 is a perspective view illustrating a state in which the connector 200 for preventing unlocking and the target object 300 are screw-coupled to each other like in FIG. 6, and thus the unlocking therebetween is prevented.

Figure 8:
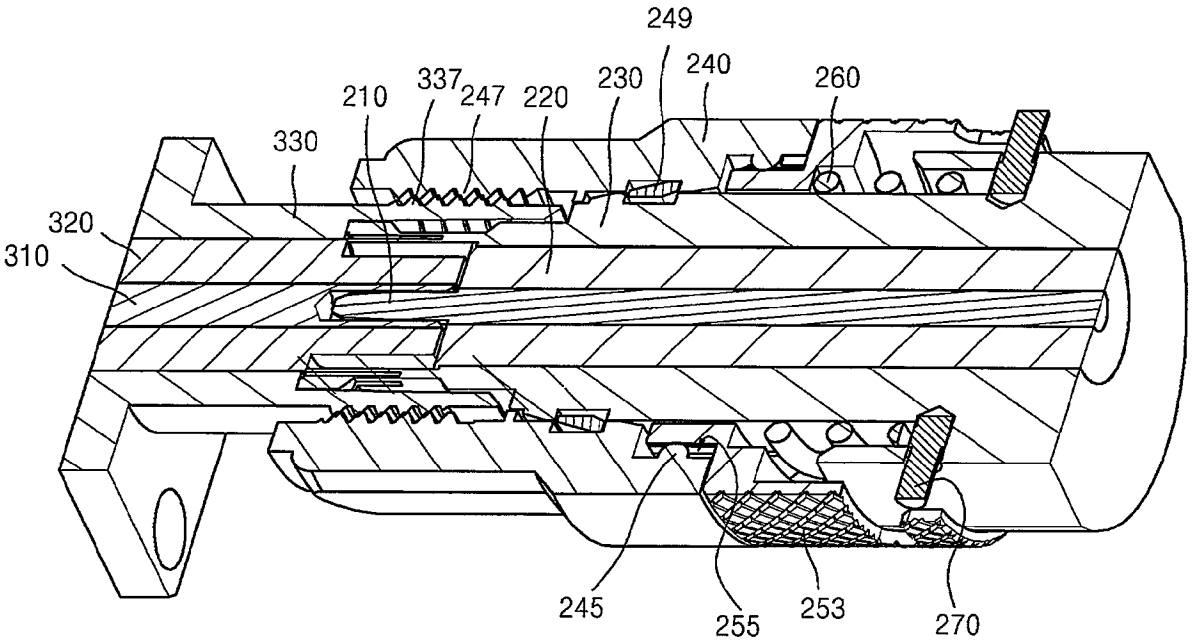
FIG. 8 is a cross-sectional perspective view taken along a line a-a' of the connector for preventing unlocking and the target object of FIG. 7.
Figure 9:
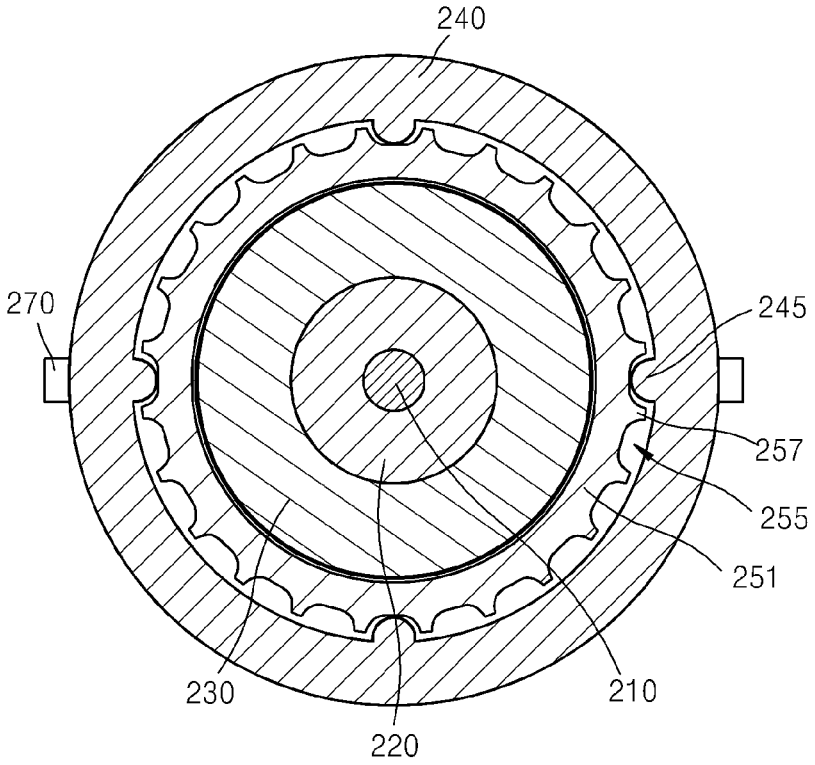
FIG. 9 is a cross-sectional perspective view taken along a line b-b' of the connector for preventing unlocking and the target object of FIG. 7.

FIG. 8 is a cross-sectional perspective view taken along a line a-a' of the connector 200 for preventing unlocking and the target object 300 of FIG. 7, and FIG. 9 is a cross-sectional perspective view taken along a line b-b' of the connector 200 for preventing unlocking and the target object 300 of FIG. 7.

Referring to FIGS. 2 to 9, one end of the connector 200 for preventing unlocking may be coupled with the target object 300. The target object 300 may be a cable (e.g., a coaxial cable), an electronic device or the like. For example, in the case that the target object 300 transfers a high frequency signal, the connector 200 for preventing unlocking may be a radio frequency (RF) connector transferring a high frequency signal. The other end of the connector 200 for preventing unlocking may be coupled with other target object such as the cable and the electronic device. For example, if the target object is fixed to the other end of the connector 200 for preventing unlocking by soldering or the like, the unlocking is not an issue. If the target object is also screw-coupled to the other end of the connector 200 for preventing unlocking, like in the one end thereof, and thus it is necessary to prevent the unlocking, a structure of the connector 200 for preventing unlocking, which will be described below, may be also applied identically to the other end thereof.

The target object 300 may include an internal conductor 310 transferring a signal, a housing 330 transferring a ground voltage, and an insulator 320 electrically insulating between the internal conductor 310 and the housing 330. An outer circumferential surface of a portion of the housing 330, which is coupled with the connector 200 for preventing unlocking, may have a thread groove 337 screw-coupled with a thread groove 247 defined in an inner circumferential surface of a first housing 240 of the connector 200 for preventing unlocking. When one of the thread grooves 247 and 337 is a female thread groove, and the other is male thread groove. However, the target object 300 of FIGS. 2 and 3 merely is an example, and the connector 200 for prevent unlocking according to one embodiment of the present invention is not always coupled with the target object 300 of FIGS. 2 and 3.

The connector 200 to prevent unlocking may include a signal pin 210, an insulator 220, a body 230, a first housing 240, a second housing 250 and an elastic body, or elastic member, 260.

The signal pin 210 may be electrically connected with the internal conductor 310 of the target object 300 to transfer a signal to another target object. The body 230 may be electrically connected with the housing 330 of the target object 300 to transfer a ground voltage to another target object. The signal pin 210 is inserted into a hollow portion defined in the body 230, and the insulator 220 is disposed between an outer circumferential surface of the signal pin 210 and an inner circumferential surface of the body 230 so as to electrically insulate between the signal pin 210 and the body 230.

One end of the body 230 may be inserted into a hollow portion defined in the first housing 240. The first housing 240 may have the thread groove 247 defined in inner circumferential surface of one end thereof to be screw-coupled by rotation. A portion of the first housing 240, in which the thread groove 247 is defined, is spaced part from the body 230 at a predetermined distance, and a portion of the housing 330 of the target object 300, in which the thread groove 337 is defined, is inserted into a defined space so that the thread groove 247 of the housing 240 and the thread groove 337 of the target object 300 are screw-coupled with each other.

The first housing 240 may have at least one protruding portion 245 provided at an inner circumferential surface of the other end thereof. A portion of the first housing 240, on which the protruding portion 245 is provided, is spaced apart from the body 230 so that a portion of the second housing 250, in which fixing grooves 255 are defined, is inserted therebetween. An end of the protruding portion 245 may have various shapes such as a pillar, a semi-circle and a ball. However, the shape is not limited thereto, and if the protruding portion 245 may be coupled to the fixing grooves 255 so as to prevent rotation of the first housing 240, the end thereof may have other various shapes. The protruding portion 245 may be integrally formed on the inner circumferential surface of the first housing 240, as illustrated in FIG. 4, or may be coupled to the first housing 240, as illustrated in FIG. 5. For example, as illustrated in FIG. 5, the protruding portion 245 may be inserted into a groove defined in the body 240-1, and a cover 240-2 is coupled to a portion of the body 240-1, in which the protruding portion 245 is inserted, whereby the above-mentioned first housing 240 may be provided.

The first housing 240 may have an axial movement preventing portion 249 protruding along an inner circumferential surface thereof between the portion having the thread groove 247 and the portion having the protruding portion 245. The axial movement preventing portion 249 is inserted into a groove defined in the outer circumferential surface of the body 230 so as to prevent an axial movement of the first housing 240. The axial movement preventing portion 249 may have an inclined outer surface having elasticity. For example, the axial movement preventing portion 249 is inserted into the groove defined in the outer circumferential surface of the body 230 so as to provide elasticity toward a center axis thereof, such that the body 230 is prevented from being separated and thus the axial movement of the first housing 240 is also prevented. Further, the axial movement preventing portion 249 may have a ring-shaped inclined outer surface which is partly cut away. In this case, the axial movement preventing portion 249 is inserted into the groove defined in the outer circumferential surface of the body 230 so as to allow rotation of the first housing 240 but prevent the axial movement thereof. The axial movement preventing portion 249 may be integrally formed with the first housing 240, as illustrated in FIG. 4, or may be inserted into the groove defined in the outer circumferential surface of the body 230 or a groove defined in the inner circumferential surface of the first housing 240, as illustrated in FIG. 5.

The second housing 250 is inserted onto the other end of the body 230 through a hollow portion defined therein, and moved along the outer circumferential surface of the body 230 in the axial direction. The second housing 250 may receive elasticity from the elastic body 260. The elastic body 260 may be coupled to the outer circumferential surface of the body 230 to be in close contact therewith or spaced apart therefrom. The elastic body 260 may be a wave washer, a coil spring, a plate spring or the like. For example, as illustrated in FIG. 3, the elastic body 260 is supported by the other end of the body 230 and provides the elasticity to the second housing 250.

The second housing 250 may have the plurality of fixing grooves 255 which are defined in the outer circumferential surface of one end thereof so that the protruding portion 245 is inserted. A boundary portion 257 is provided between the fixing grooves 255. A width of the boundary portion 257 is smaller than that of the protruding portion 245 so that the protruding portion 245 is not stopped by the boundary portion 257, but easily inserted into the fixing grooves 255. An end of the boundary portion 257 on a side of the protruding portion 245 has an inclined portion between upper and lower surfaces thereof, and thus the protruding portion 245 is not stopped by the boundary portion 257, but easily inserted into the fixing grooves 255. However, the boundary portion 257 is not limited thereto, and the boundary portion 257 may have various shapes, if the protruding portion 245 may be easily inserted into the fixing grooves 255.

In the second housing 250, first and second coupling portions 251 and 253 may be integrally formed. As illustrated in FIG. 4, the first coupling portion 251 has the fixing grooves 255 defined in an outer circumferential surface thereof. The first coupling portion 251 is moved in the axial direction and inserted between the portion of the first housing 240, on which the protruding portion 245 is provided, and the outer circumferential surface of the first body 230, and thus the fixing grooves 255 and the protruding portion 245 may coupled with each other. Further, as illustrated in FIG. 5, a ring that the fixing grooves 255 and the boundary portion 257 are formed at the outer circumferential surface thereof may be coupled to the first coupling portion 251 in a fitting manner.

The second coupling portion 253 has larger inner and outer diameters than the first coupling portion 251. When the fixing grooves 255 and the protruding portion 245 are coupled with each other, one end of the second coupling portion 253 may be in contact with the other end of the first housing 240. For example, when the elastic body 260 provides the elasticity to the second housing 250, the second housing 250 moved in the axial direction, and the first coupling portion 251 is inserted between the portion of the first housing 240, on which the protruding portion 245 is provided, and the outer circumferential surface of the first body 230, and thus the fixing grooves 255 and the protruding portion 245 may coupled with each other. In this case, since the second housing 250 receives the elasticity from the elastic body 260 toward the first housing 240, one end of the second coupling portion 253 may be in close contact with the other end of the first housing 240.

The second coupling portion 253 may have at least one through-hole 259 defined in the other end thereof. The through-hole 259 may be coupled with a protrusion 270 provided on the body 230 in order to prevent an axial movement or rotation of the second housing 250. The through-hole 259 may include an axial movement preventing through-hole 259-1 and a rotation preventing through-hole 259-2 which may be integrally defined. The axial movement preventing through-hole 259-1 in which the protrusion 270 is inserted in order to prevent the axial movement of the second housing 240 may be defined in a direction that is not parallel with the axial direction (e.g., a direction vertical to the axial direction) to have a similar width to the protrusion 270. And the rotation preventing through-hole 259-2 in which the protrusion 270 is inserted in order to prevent the rotation of the second housing 240 may be defined in the axial direction to have a similar width to the protrusion 270. For example, the through-hole 259 may have an L shape, as illustrated in drawings.

Hereinafter, a state in which the target object 300 is coupled to the connector 200 for preventing unlocking and thus the unlocking therebetween is prevented will be described.

First of all, referring to FIGS. 2 and 3, a state before the connector 200 for preventing unlocking and the target object 300 are coupled to each other will be described. As illustrated in FIGS. 2 and 3, while the fixing grooves 255 of the second housing 250 and the protruding portion 245 of the first housing 240 are not coupled to each other, the connector 200 for preventing unlocking may be coupled with the target object 300. That is, since the protruding portion 245 is not coupled with the fixing grooves 255 and thus the first housing 240 is freely rotated, the first housing 240 may be screw-coupled with the target object 300. In order to maintain the state in which the fixing grooves 255 of the second housing 250 are not coupled with the protruding portion 245 of the first housing 240, the protrusion 270 of the body 230 is moved in the axial direction and coupled to the axial movement preventing through-hole 259-1, and thus the second housing 250 may be fixed to the body 230 so as to be not moved in the axial direction.

While the fixing grooves 255 and the protruding portion 245 are not coupled with each other, a state in which the connector 200 for preventing unlocking is coupled with the target object 300 is like in FIG. 6. In this case, the coupling between the first housing 240 and the housing 330 of the target object 300 may be unlocked, as time passed. Therefore, in the present invention, after the first housing 240 and the housing 330 of the target object 300 are screw-coupled with each other, the second housing 250 is moved in the axial direction, like in FIGS. 7 to 9, so that the protruding portion 245 is coupled to the fixing grooves 255, whereby it is possible to prevent the unlocking between the connector 200 for preventing unlocking and the target object 300.

Referring to FIGS. 7 to 9, while the first housing 240 are the target object 300 are screw-coupled with each other, the second housing 250 is moved in the axial direction (to the left in drawing), and thus the protruding portion 245 of the first housing 240 may be coupled to the fixing grooves 255 of the second housing 250. That is, since the protruding portion 245 is coupled to the fixing grooves 255 and the second housing 250 is fixed, the first housing 240 may not be rotated in any direction. Since the first housing 240 screw-coupled to the housing 330 of the target object 300 may not be rotated in any direction, the unlocking between the connector 200 for preventing unlocking and the target object 300 does not occur. The second housing 250 may be moved in the axial direction by the elasticity received from the elastic body 260. While the fixing grooves 255 of the second housing 250 and the protruding portion 245 of the first housing 240 are coupled with each other, the protrusion 270 formed on the body 230 is coupled to the axial movement preventing through-hole 259-1 so that the second housing 250 is fixed to the body 230, whereby it is possible to prevent the rotation of the first housing 240.

However, use of the above-mentioned configuration is just one exemplary embodiment according to technical spirit of the present invention, and other various configurations may be used so that, while the connector 200 for preventing unlocking and the target object 300 are being coupled with each other, the state in which the fixing grooves 255 and the protruding portion 245 are not coupled with each other is maintained, and after the connector 200 for preventing unlocking and the target object 300 are coupled with each other, the state in which the fixing grooves 255 and the protruding portion 245 are coupled with each other is maintained. For example, the elastic body 260 may be coupled between one end of the first coupling portion 251 of the second housing 250 and the first housing 240 so as to provide the elasticity to a right side. In this case, in order to maintain the state in which the fixing grooves 255 and the protruding portion 245 are not coupled with each other, the second housing 250 may be fixed by receiving the elasticity applied to the right side, and the protrusion 270 may be coupled in the rotation preventing through-hole 259-2. In order to maintain the state in which the fixing grooves 255 and the protruding portion 245 are coupled with each other, the second housing 250 may be moved to a left side and fixed, and the protrusion 270 may be coupled in the axial movement preventing through-hole 259-1. Further, the through-hole 259 may have other shapes, and the state in which the fixing grooves 255 and the protruding portion 245 are coupled or not coupled with each other may be maintained by using other various configurations instead of the through-hole 259 and the protrusion 270.

Figure 10:
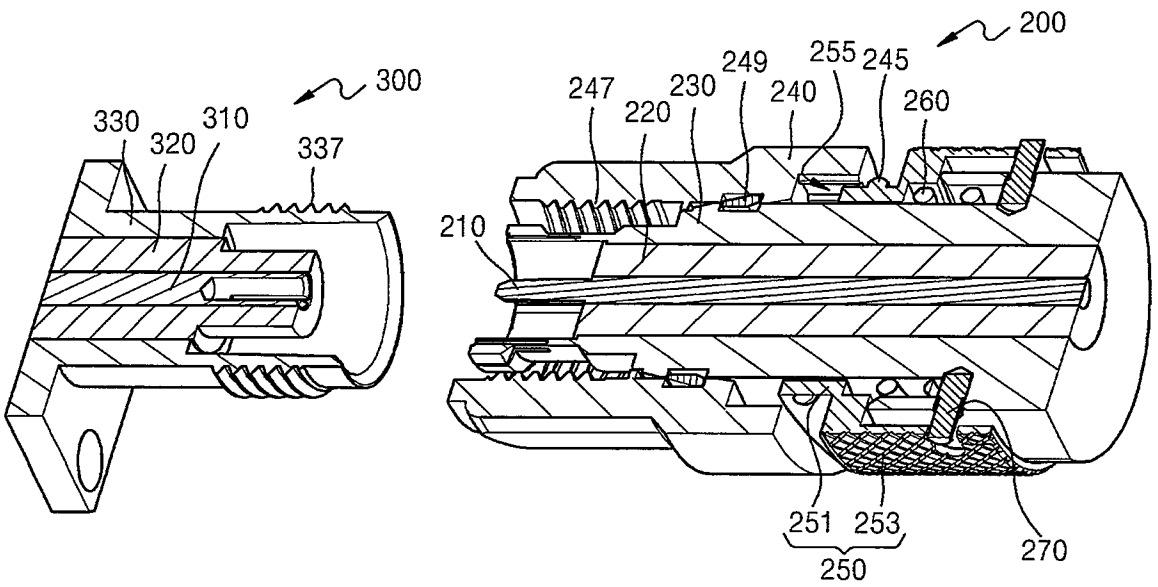
FIG. 10 is a cross-sectional perspective view taken along a line a-a' of the connector for preventing unlocking and the target object of FIG. 2 according to another exemplary embodiment of the present invention.

FIG. 10 is a cross-sectional perspective view taken along a line a-a' of the connector 200 for preventing unlocking and the target object 300 of FIG. 2 according to another exemplary embodiment of the present invention.

Figure 11:
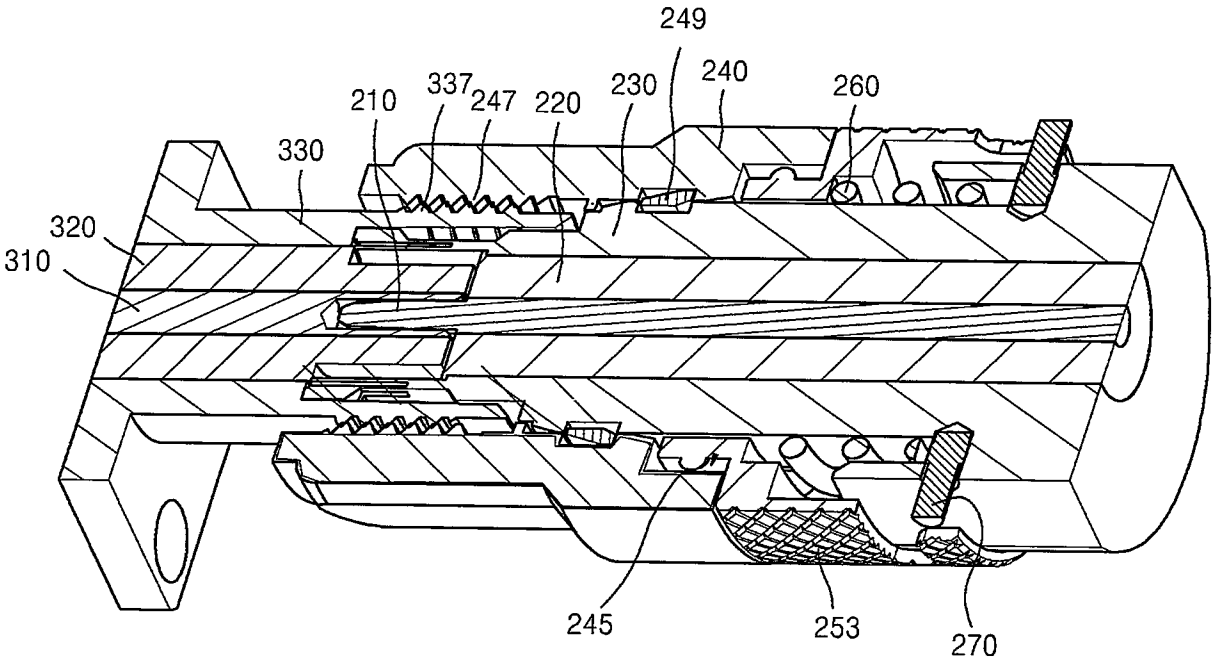
FIG. 11 is a cross-sectional perspective view taken along a line a-a' of the connector for preventing unlocking and the target object of FIG. 10 which are screw-coupled to each other like in FIG. 7 so that the unlocking therebetween is prevented.

FIG. 11 is a cross-sectional perspective view taken along a line a-a' of the connector 200 for preventing unlocking and the target object 300 of FIG. 10 which are screw-coupled to each other like in FIG. 7 so that the unlocking therebetween is prevented.

Figure 12:
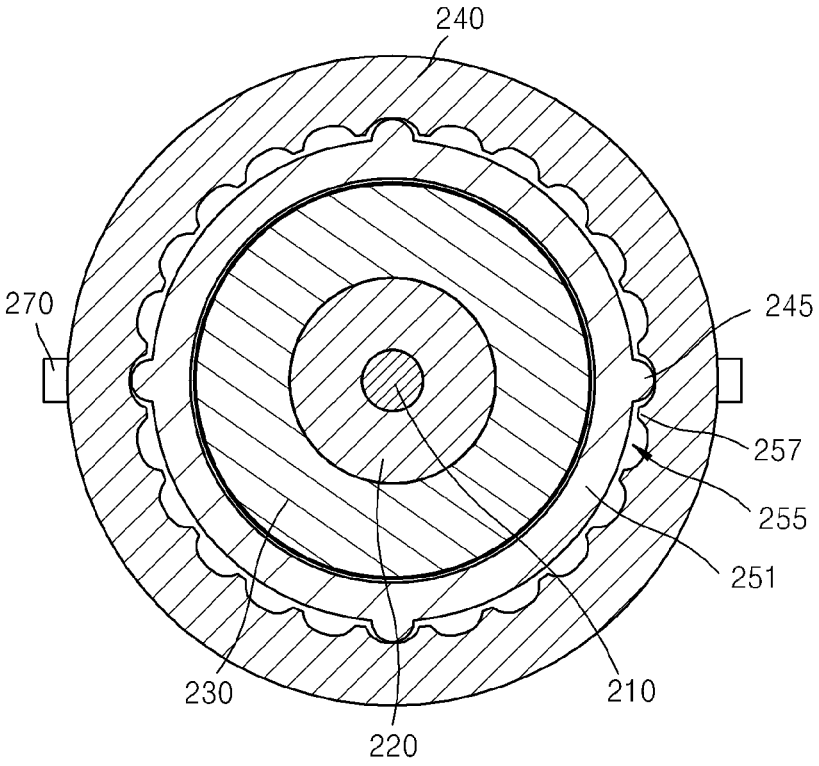
FIG. 12 is a cross-sectional perspective view taken along a line b-b' of the connector for preventing unlocking and the target object of FIG. 10 which are screw-coupled to each other like in FIG. 7 so that the unlocking therebetween is prevented.

FIG. 12 is a cross-sectional perspective view taken along a line b-b' of the connector 200 for preventing unlocking and the target object 300 of FIG. 10 which are screw-coupled to each other like in FIG. 7 so that the unlocking therebetween is prevented.

Referring to FIGS. 2, 6, 7 and 10 to 12, the connector 200 for preventing unlocking according to another embodiment of the present invention is the same as that in FIGS. 1 to 9, except that at least one protruding portion 245 is formed on the second housing 250 and the fixing grooves 255 are defined in the first housing 240. That is, at least one protruding portion 245 is integrally formed with an outer circumferential surface of the first coupling portion 251 of the second housing 250, or a ring having at least one protruding portion 245 may be coupled in a fitting manner. And the fixing grooves 255 may be defined in the inner circumferential surface of the other end of the first housing 240. The state in which the protruding portion 245 is inserted and coupled into the fixing grooves 255 according to the axial movement of the second housing 250 is the same as that in FIGS. 1 to 9, and thus description thereof will be omitted.

It will be apparent to those skilled in the art that various modifications and variations can be made in the present invention. Thus, it is intended that the present invention covers the modifications and variations of this invention provided they come within the scope of the appended claims and their equivalents.

[Industrial Applicability]

In the connector for preventing unlocking according to one embodiment of the present invention, since a target object is screw-coupled to the connector without a separate wire, and the protruding portion and the fixing grooves are coupled with each other so that the connector coupled with the target object is not rotated in any direction, it is possible to minimize the assembly time and also to prevent the unlocking between the connector and the target object. Further, since the protruding portion and the fixing grooves are formed in the housing, it is possible to prevent the protruding portion and the fixing groove from being damaged by foreign substances.

The invention claimed is:

1. A connector for preventing unlocking, comprising:

a signal pin transferring a signal;

a body having one end into which the signal pin is inserted and which is electrically isolated from the signal pin by an insulator and transfers a ground voltage;

a first housing having a hollow portion defined therein, wherein one end of the body is inserted into the hollow portion of the first housing, a threaded portion for coupling to a threaded portion of a target object, wherein the threaded portion is formed in an inner circumferential surface of one end of the first housing, and at least one protruding portion formed on an inner circumferential surface of the other end of the first housing;

a second housing having a hollow portion defined therein, wherein the other end of the body is inserted into the hollow portion of the second housing, wherein the second housing is moved along an outer circumferential surface of the body in an axial direction, and a plurality of fixing grooves formed in an outer circumferential surface of one end of the second housing; and an elastic member which is supported by the body and provides elasticity to the second housing, wherein the elasticity enables the second housing to move in the axial direction toward the first housing, wherein, when the one end of the second housing is inserted and fixed between the inner circumferential surface of the other end of the first housing and an outer circumferential surface of the body, the at least one protruding portion is coupled into the plurality of fixing grooves so as to prevent rotation of the first housing, wherein the body has at least one protrusion formed on the other end of the body, and the second housing has at least one through-hole defined in the other end of the second housing, wherein the at least one protrusion is coupled to the at least one through-hole thereby preventing the second housing from being moved in the axial direction and rotated, wherein, in order to couple the threaded portion of the first housing to the threaded portion of the target object, the at least one protrusion is coupled to the at least one through-hole in a state in which the fixing grooves and the at least one protruding portion are separated from each other, thus the second housing is fixed to the body and prevented from being moved in an axial direction, when the at least one protruding portion is coupled to the fixing grooves, the second housing is fixed to the body and prevented from being moved in the axial direction and rotated, wherein the second housing comprises a first coupling portion which has the fixing grooves defined in the outer circumferential surface of the second housing, and is moved along the outer circumferential surface of the body in the axial direction, when receiving the elasticity from the elastic member, is configured such that the at least one protruding portion formed on the first housing is inserted into the fixing grooves; a second coupling portion which is integrally formed with the first coupling portion, and has larger inner and outer diameters than the first coupling portion, and of which one end is in close contact with the other end of the first housing when a portion of the second coupling portion coupled with the first coupling portion receives the elasticity from the elastic member, and the other end of the second coupling portion has the at least one through-hole.

2. The connector of claim 1, wherein, when the at least one protruding portion is coupled to the fixing grooves, the elastic body provides the elasticity to the second housing toward the first housing so as to prevent the first housing from being moved in the axial direction.

3. The connector of claim 1, wherein the through-hole comprises an axial movement preventing through-hole defined in a direction that is not parallel with the axial direction so that the protrusion is coupled therein and thus the second housing is fixed to the body and prevented from being moved in the axial direction; and a rotation preventing through-hole which is integrally defined with the axial movement preventing through-hole and defined in the axial direction so that the protrusion is coupled therein and thus the second housing is fixed to the body and prevented from being rotated.

4. The connector of claim 1, wherein an end of the protruding portion has a rounded shape, and a boundary portion between the fixing grooves has a smaller width than the protruding portion so that the protruding portion and the fixing grooves are easily coupled with each other, and an end of the boundary portion on a side of the protruding portion has an inclined portion.

5. The connector of claim 1, wherein the first housing has an axial movement preventing portion which protrudes along an inner circumferential surface between the threaded portion and the at least one protruding portion so as to be inserted into a groove defined in the outer circumferential surface of the body and thus prevent the first housing from being moved in the axial direction.

6. The connector of claim 1, wherein the connector for preventing unlocking is a radio frequency (RF) connector transferring a high frequency signal.

7. A connector for preventing unlocking, comprising:

a signal pin transferring a signal;

a body having one end into which the signal pin is inserted and which is electrically isolated from the signal pin by an insulator and transfers a ground voltage;

a first housing having a hollow portion defined therein, wherein one end of the body is inserted into the hollow portion of the first housing, a threaded portion for coupling to a threaded portion of a target object, wherein the threaded portion is formed in an inner circumferential surface of one end of the first housing, and a plurality of fixing grooves formed in an inner circumferential surface of the other end of the first housing;

a second housing having a hollow portion defined therein, wherein the other end of the body is inserted into the hollow portion of the second housing, wherein the second housing is moved along an outer circumferential surface of the body in an axial direction, and at least one protruding portion formed on an outer circumferential surface of one end of the second housing; and an elastic member which is supported by the body and provides elasticity to the second housing, wherein the elasticity enables the second housing to move in the axial direction toward the first housing, wherein, when the one end of the second housing is inserted and fixed between the inner circumferential surface of the other end of the first housing and an outer circumferential surface of the body, the at least one protruding portion is coupled into the plurality of fixing grooves so as to prevent rotation of the first housing, wherein the body has at least one protrusion formed on the other end of the body, and the second housing has at least one through-hole defined in the other end of the second housing, wherein the at least one protrusion is coupled to the at least one through-hole, thereby preventing the second housing from being moved in the axial direction and rotated, wherein, in order to couple the threaded portion of the first housing to the threaded portion of the target object, the at least one protrusion is coupled to the at least one through-hole in a state in which the fixing grooves and the at least one protruding portion are separated from each other, thus the second housing is fixed to the body and prevented from being moved in an axial direction, when the at least one protruding portion is coupled to the fixing grooves, the second housing is fixed to the body and prevented from being moved in the axial direction and rotated, wherein the second housing comprises a first coupling portion which has the at least one protruding portion defined in the outer circumferential surface of the second housing, and is moved along the outer circumferential surface of the body in the axial direction, when receiving the elasticity from the elastic member, is configured such that the at least one protruding portion formed on the second housing is inserted into the fixing grooves defined in the first housing; and a second coupling portion which is integrally formed with the first coupling portion, and has larger inner and outer diameters than the first coupling portion, and of which one end is in close contact with the other end of the first housing when a portion of the second coupling portion coupled with the first coupling portion receives the elasticity from the elastic member, and the other end of the second coupling portion has the at least one through-hole.

* * * * *